US006245392B1

(12) United States Patent
Hillenbrand

(10) Patent No.: US 6,245,392 B1
(45) Date of Patent: Jun. 12, 2001

(54) COATER APPARATUS AND METHOD

(76) Inventor: Stephen J. Hillenbrand, 2643 Bafford Pl., Knoxville, TN (US) 37920

( * ) Notice: Subject to any disclaimer, the term of this patent is extended or adjusted under 35 U.S.C. 154(b) by 0 days.

(21) Appl. No.: 09/384,757

(22) Filed: Aug. 27, 1999

(51) Int. Cl.[7] ..... B05D 1/02; B05D 3/06; C08J 7/04; C08J 7/18

(52) U.S. Cl. ..... 427/498; 427/500; 427/512; 427/514

(58) Field of Search ..... 427/498, 512, 427/500, 514, 137

(56) References Cited

U.S. PATENT DOCUMENTS

| | | | | |
|---|---|---|---|---|
| 3,472,200 | | 10/1969 | Gerling . | |
| 3,627,562 | | 12/1971 | Hammelmann . | |
| 3,853,443 | | 12/1974 | Grillos . | |
| 4,289,798 | * | 9/1981 | Bagley et al. . | |
| 4,411,931 | * | 10/1983 | Duong . | |
| 4,765,773 | | 8/1988 | Hopkins . | |
| 4,999,216 | * | 3/1991 | Gaske et al. | 427/512 |
| 5,449,534 | * | 9/1995 | Oishi et al. | 427/512 |
| 5,529,815 | | 6/1996 | Lemelson . | |
| 5,599,133 | | 2/1997 | Costello et al. . | |
| 6,096,383 | * | 8/2000 | Berg et al. | 427/512 |

* cited by examiner

*Primary Examiner*—Marianne Padgett
(74) *Attorney, Agent, or Firm*—Luedeka, Neely & Graham, P.C.

(57) ABSTRACT

The invention provides a mobile coating and curing apparatus for applying and curing an ultraviolet or an electron beam curable material. The apparatus includes a housing containing a first compartment containing a coater, a second compartment containing an ultraviolet or electron beam curing energy source, a partition wall between the first and second compartments and a means for moving the housing across a surface to be coated. The apparatus provides a means for coating surfaces which are generally too large to be coated by stationary coating and curing devices.

6 Claims, 3 Drawing Sheets

COATER APPARATUS AND METHOD

FIELD OF THE INVENTION

The invention relates to a mobile coater apparatus and method for coating a surface with an ultraviolet or electron beam curable coating and a method for curing the coating.

BACKGROUND

Various types of coatings are applied to surfaces in order to protect the surfaces from corrosion or to provide a surface having a particular desirable characteristic or property. Many of the coatings are applied by conventional methods, such as spraying, dipping or rolling the coatings onto the surface. Water-based or oil-based coatings applied by these methods are typically air dried or heat dried either by convective heat, radiant heat or microwave energy and the like.

Coatings which require more elaborate methods of curing such as ultraviolet or electron beam curing methods are typically conducted by placing the coated materials in a stationary curing device. This method works well for object which are small enough to fit into the curing device. For extremely large objects or surfaces too large or cumbersome to transport or move through such devices, alternate coating materials which may be less effective than ultraviolet or electron beam curable coatings are often required to be used.

There is a need therefore for a coater apparatus and method for coating large surfaces which cannot be easily transported through stationary curing devices and/or otherwise avoids the limitations of stationary curing devices.

SUMMARY OF THE INVENTION

With regard to the above and other objects and advantages therefore the invention provides a coater apparatus which includes a housing having a top wall, side walls attached to the top wall and an open bottom defining a first compartment and a second compartment. A partition wall between the first compartment and the second compartment separates the first compartment from the second compartment. A coater selected from spray and roll coaters is disposed in the first compartment. The second compartment includes a curing energy source selected from ultraviolet and electron beam energy sources. The housing also includes wheels or rollers rotatably attached to a lower portion of the housing for moving the housing across the surface during a coating operation and for maintaining a gap between the housing walls and the surface to be coated. A control unit which may be attached to the housing or remote from the housing controls the coater and energy source during a coating and curing operation.

In another aspect the invention provides a method for coating a surface with an ultraviolet or electron beam curable coating. The method includes providing a coater apparatus of the nature described in the first aspect of the invention, applying a UV or electron beam curable coating by means of the coater apparatus and curing the coating using an ultraviolet or electron beam energy source while moving the coater apparatus across a surface to be coated.

An important advantage of the invention is that it provides an apparatus and method which may be adapted to coat and cure large surfaces with electron beam or ultraviolet curable materials. In contrast to conventional coating materials, electron beam or ultraviolet curable materials can typically be cured in a matter of seconds as opposed to hours. Another advantage of the invention is that the housing is adapted to limit escape of the coating materials to the environment during the coating step thereby generating little or no environmental emissions and significantly reducing worker exposure to such materials.

BRIEF DESCRIPTION OF THE DRAWINGS

Other aspects and advantages of the invention will become apparent by reference to the following description of preferred embodiments thereof in conjunction with the following drawings in which.

DETAILED DESCRIPTION OF THE PREFERRED EMBODIMENTS

Figure 1:
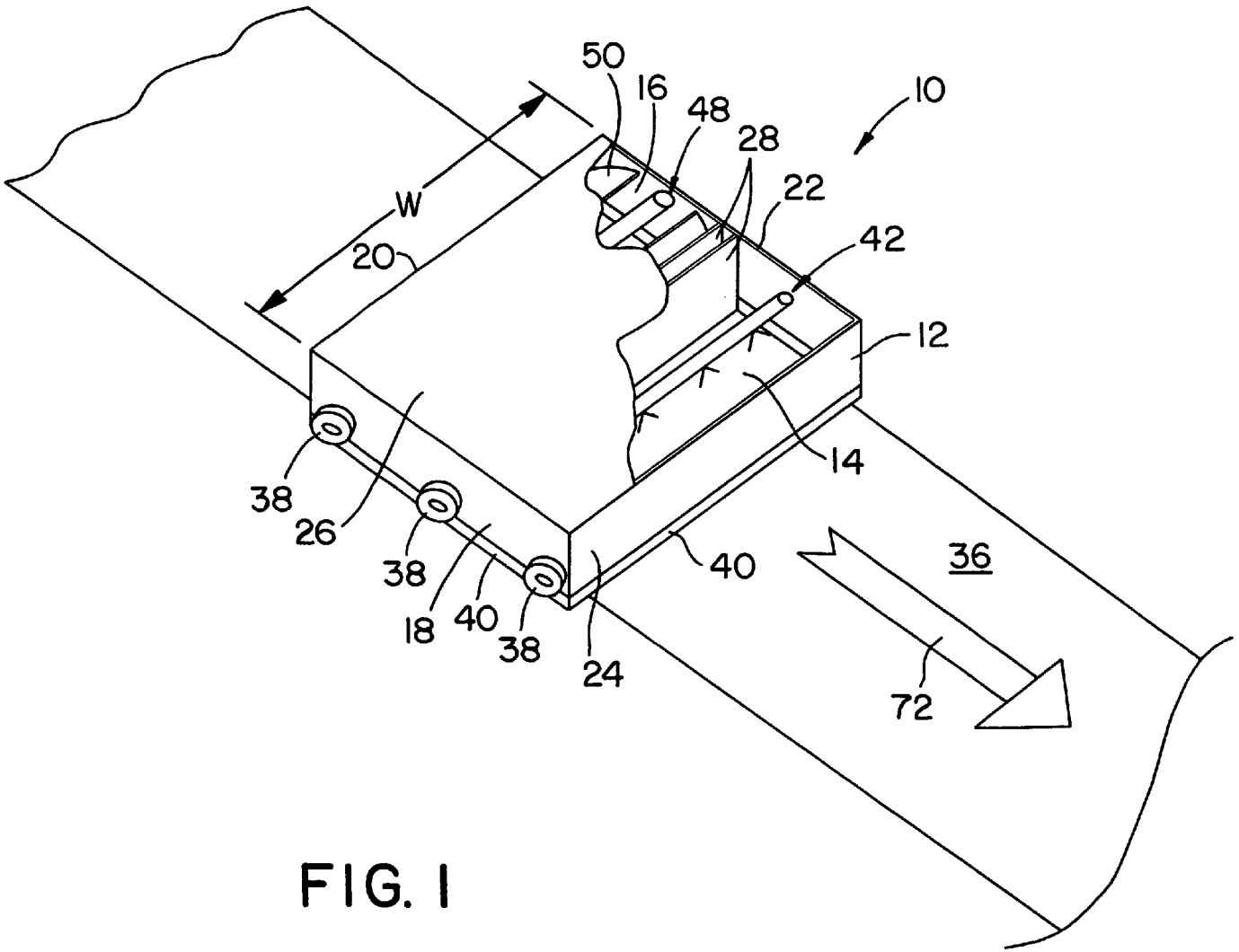
FIG. 1 is a perspective cut-away view, not to scale, of a coater apparatus according to the invention.
Figure 2:
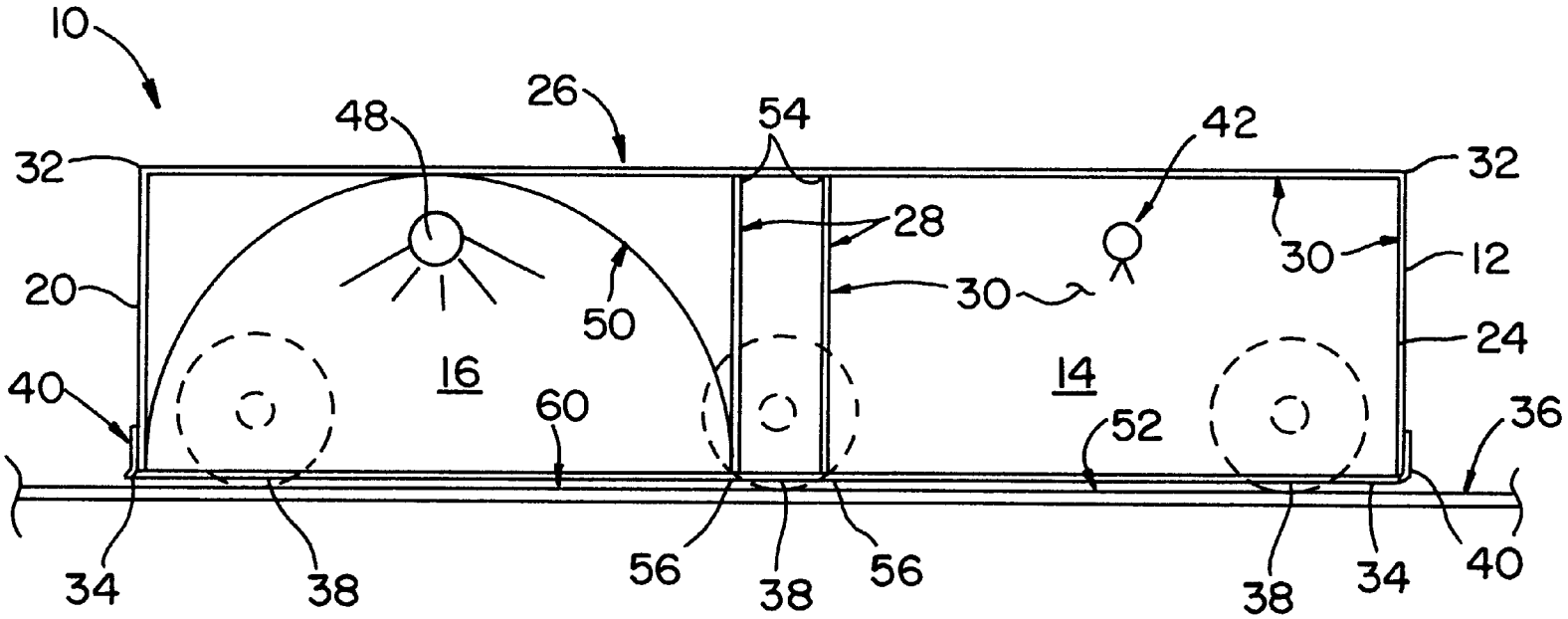
FIG. 2 is a cross sectional side view, not to scale, of a coater apparatus according to the invention.

With reference to FIGS. 1 and 2, there is provided a coater apparatus 10, comprising a housing 12 containing a first compartment 14 and a second compartment 16. The first and second compartments 14 and 16 are defined by side walls 18, 20, 22 and 24, top wall 26 and one or more partition walls 28. The housing 12 may be constructed from a variety of materials including metals such as stainless steel, mild steel and aluminum, and polymeric materials such as fiberglass, high density polyethylene, polypropylene, polyvinyl chloride and the like. Regardless of the materials of construction of the housing, it is preferred that the interior surfaces 30 of side walls 18, 22 and 24, top wall 26 and partition wall(s) 28 defining the first compartment 14 be coated with a release coating or liner which is resistant to the ultraviolet or electron beam curable coating materials which may be applied with the coater apparatus 10. Suitable release coatings or liners may be selected from a fiberglass coating, a fluorocarbon coating, a polyamide coating, a polypropylene coating and the like. A preferred release coating is a polyamide coating.

The side walls 18,20,22 and 24 ofthe housing 12 have a height ranging from about 6 inches to about 24 inches and a length ranging from about 24 inches to about 96 inches. Accordingly the preferred overall dimensions of housing 12 ranges from about 3 to about 4 feet in length, from about 3 to about 4 feet in width and from about 1 to about 2 feet high. The dimensions of the housing 12 may be larger or smaller as desired provided the size of the apparatus is suitable for carrying out the purposes of the invention.

Each of the side walls 18, 20, 22 and 24 has a first edge 32 connected to the top wall 26 and a second edge 34 opposite the first edge 32. The second edge 34 of the side walls is adjacent a surface 36 to be coated and is maintained a predetermined distance from the surface 36 ranging from about ¼ inch to about 6 inches by wheels or rollers 38 which are rotatably attached to side walls 18 and 22. The preferred predetermined distance from the second edge 34 of the side walls to surface 36 is about 1 inch.

It is particularly preferred to include a flexible skirt 40 attached adjacent the second edges 34 of side walls 18, 20, 22 and 24. The flexible skirt 40 preferably does not contact the surface 36 to be coated and is maintained a distance of not more than about 6 inches above the coated surface. The flexible skirt 40 may be made of a wide variety of resilient flexible materials including canvas, rubber, polyethylene film and the like, and is provided to reduce overspray of coating material exterior to the housing 12 and to reduce contact of debris with the coated surface until the coating is cured.

The first compartment 14 as defined above includes a coater 42 which may be selected from a spray coater, a roll coater, a blade coater and the like which is sufficient to apply a coating thickness ranging from about 0.5 mils to about 0.25 inches onto the surface 52 covered by the first compartment 14.

The coater 42 preferably has a length which spans the width W of the first compartment 14. When the coater 42 is a spray coater it is preferred that the coater be located in the first compartment 14 a distance of not less than about 0.5 feet from the surface 36 to be coated. From a practical point of view, the maximum distance of the spray coater 42 is typically no more than about 1.0 foot from the surface 36 to be coated. It will be recognized however, that the spray coater 42 may be located at a distance of less than 0.5 feet or more than 1 foot from the surface 36 to be coated depending on the dimensions of the coater apparatus 10, and the effectiveness, size or number of spray coaters 42 in the first compartment 14.

For contact type coaters 42 such as roll coaters, blade coaters and the like, the coater 42 is preferable in direct contact with the surface 36 to be coated. For such coaters 42, the dimensions of the first compartment 14 are less critical and thus the first compartment 14 may have a substantially smaller dimension with respect to its longitudinal dimension parallel with side walls 18 and 22 than the length dimension of the second compartment 16. It is preferred that the width W of each compartment 14 and 16 remain substantially the same.

Figure 3:
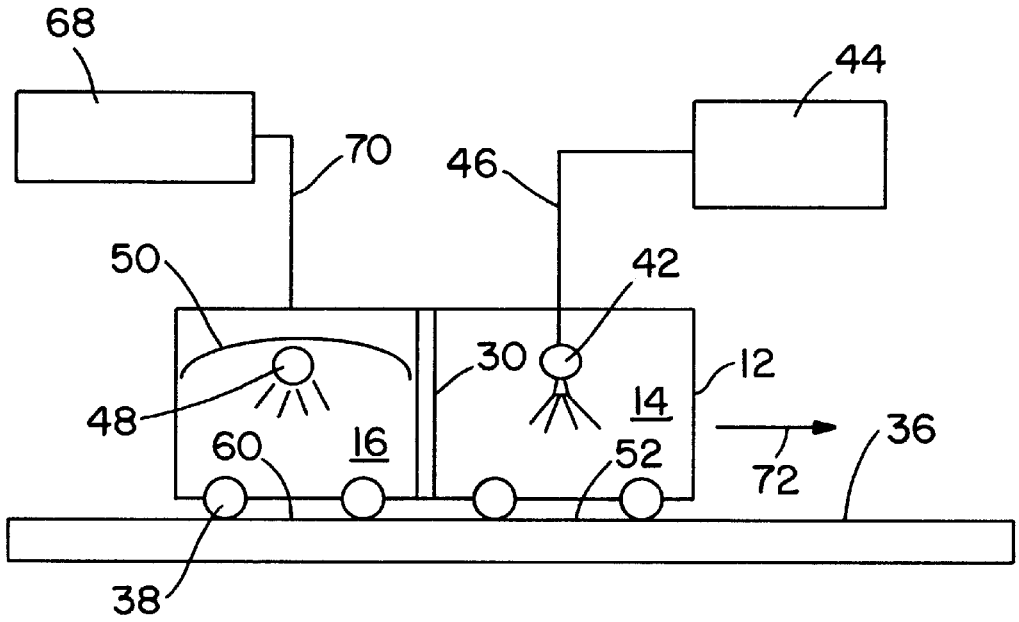
FIG. 3 is a schematic diagram of a coater apparatus according to the invention.

The coating materials may be in a container attached to or contained in the first compartment 14 and supplied to the coater 42 by means of a pump or by means of gravity from a supply source which may also be attached to or contained in the first compartment 14. In the alternative, the coating material may be contained in a separate device or container 44 remote from the housing 12 of the coater apparatus 10 and provided to the coater 42 by means of a flexible or rigid conduit 46 connected to the coater 42 as illustrated schematically in FIG. 3. A flow control device or pressure control device may also be included to provide a constant flow of coating material to the coater 42 in order to provide a coating having a desired thickness.

The second compartment 16 which is adjacent to the first compartment 14 contains a curing device 48. The curing device 48 may be selected from an ultraviolet energy source or an electron beam energy source. For an ultraviolet energy source, the curing device 48 preferably spans a substantial part of the width W of the second compartment 16. It is also preferred that the second compartment 16 also contain a reflector 50 for directing the curing energy toward the coated surface 52 to be cured. In this regard, the curing device 48 is preferably located in the second compartment 16 a distance from the coated surface 52 which is sufficient to cure the coating as the coater apparatus 10 is moved across the coated surface 52 in the direction of arrow 72. The curing device 48 is preferably located no less than about six inches and no more than about three feet from the coated surface 52 to be cured. The optimum distance of the curing device is dependent on the dimensions of the housing 12, the power of the curing device 48, the coating thickness and formulation and the speed the coater apparatus 10 is moving relative to the coated surface 52.

A suitable ultraviolet curing device 48 is available from HONLE UV America of Marlborough, Mass. under the trade name UVAPRINT 1265 having a length of about 50 inches and containing a medium pressure mercury lamp operating at about 240 to about 400 watts per inch. A suitable electron beam curing device is available from Advanced Electron Beams of Wilmington, Mass. The curing device 48 is also preferably air cooled. One or more banks of curing devices 48 may be included in the second compartment 16 in order to cure coatings on the surface thereof at a faster rate.

Figure 4:
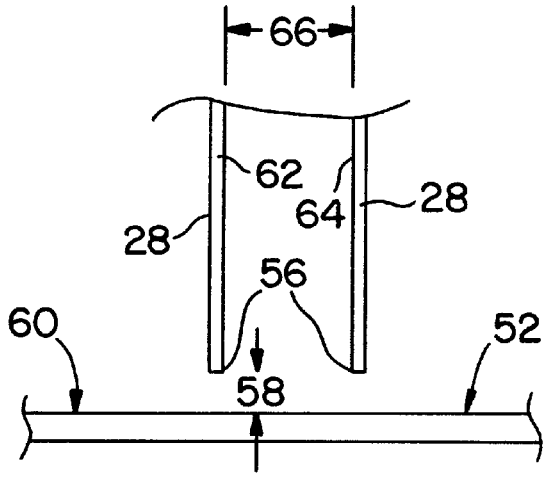
FIG. 4 is a partial side elevational view, not to scale, of a partition wall of a coater apparatus according to the invention.

With reference to FIG. 4, one or more partition walls, preferably two partition walls 28 separate the first compartment 14 from the second compartment 16. Each partition wall 28 is preferably attached on one end 54 to the top wall 26 (FIG. 2) and an opposing end 56 of the partition wall 28 is maintained a distance 58 above the. coated surface 52 which is sufficient to minimize the reflection of curing energy from a surface 60 below the second compartment 16 to the first compartment 14. Typically the partition wall 28 is maintained a distance 58 which is substantially the same as the distance of second edge 34 from the surface 36 to be coated.

It is particularly preferred that the partition wall 28 be a double partition wall having a first section 62 and a second section 64. The first and second sections 62 and 64 are preferably spaced from one another a distance 66 ranging from about 0 inches to about 6 inches or more. The preferred distance 66 between the walls 62 and 64 is at least twice the distance 58 between ends 56 of partition walls and the coated surface 52.

Referring again to FIG. 3, the power source and control unit 68 for the curing device 48 and other energy requiring devices, e.g., motors for coaters 42 and wheels 38 may be attached to the housing 12 of the coater apparatus 10 or may be separate from the housing 12. When the power source and/or control unit are separate from the housing 12 a flexible electrical conduit 70 may be used to connect the control unit and/or power source 68 to the curing device 48 and other energy requiring devices.

An important feature of the coater apparatus of the invention is that the entire housing 12 containing the coater 42 and curing device 48 is mobile such that it can be moved across a surface while applying an ultraviolet or electron beam curable coating and curing the coating. In order to transport the apparatus 10 over a surface each of the sidewalls 18 and 22 preferably contain two or more wheels or rollers 38 which are sufficient for maintaining the sidewalls 18, 20, 22 and 24 a predetermined distance from the surface and to enable the coater apparatus 10 to be propelled across the surface 36 to be coated. The coater apparatus 10 may be self propelled by including motor driven wheels or rollers 38 or the housing 12 may be moved across or along the surface 36 to be coated by a cable or robotic arm. It is preferred to maintain a constant speed of the apparatus 10 relative to the surface 36 in order to provide the desired coating thickness and to sufficiently cure the coating. For variable speed movement of the housing 12, the control unit 68 preferably includes electronic devices which are sufficient to vary the curing energy of the curing device 48 and/or the coating flow rate from the coater 42 such that the coating and curing steps are compatible with the speed of the housing 12 across the surface 36.

The coater apparatus 10 is preferably moved at a speed of from about 0 to about 30 feet per minute or more which is adapted to coat and cure a coating which is applied at a predetermined fixed rate. In the alternative described above, a control device is provided to apply the coating and cure the coating at a rate which is compatible with a range of speeds at which the coater apparatus is moved across the surface. Accordingly, one input to the control device may be the speed of the coater apparatus 10 across surface 36.

For critical coating applications it may be desirable to include other sensing devices which may be used to provide adjustment or control the speed, curing energy power source or coater operation. Such devices may include, but are not limited to speed sensors, temperature sensors, thickness gauges, reflectometers and the like.

For horizontal surfaces to be coated, the coater apparatus 10 may be moved along the surface described above using cables, tracks, robotic arms and/or other external motive devices. However, for surfaces which are not substantially horizontal, i.e. vertical surfaces, curved surfaces, and surfaces which make an angle of from 0 to 90 degrees with respect to a horizontal plane, it may be desirable to include surface contact maintaining devices. Such devices may include robotic arms which engage housing 12, specially designed tracks on scafolding or other structures adjacent the surface 36 to be coated which engage wheels 38 or attach to housing 12 and maintain the housing 12 in close adjacency to the surface 36 to be coated. Other means may include permanent or electromagnetic wheels which are attracted to iron containing surfaces, permanent magnet or electromagnetic devices attached to one or more portions of side walls 18, 20, 22 or 24 and the like.

During a coating and curing operation, the housing 12 containing the coater 42 and curing device 48 is moved across a surface 36 to be coated in a direction indicated by arrow 72. As the coater apparatus is being moved, a coating is applied to the surface 36 by coater 42 so that an uncured layer of coating material having a thickness ranging from about 0.5 mils to about 0.25 inches is formed on a surface 52 under the first compartment 14. Essentially simultaneously with coating the surface 52, the coating on surface 60 beneath second compartment 16 is cured as ultraviolet or electron beam energy is emitted from curing device 48 with an intensity sufficient to cure the layer of coating material. By selecting a desired curing energy for the selected coating thickness and translation speed of the coater apparatus across the surface 60, a fully cured coating layer is produced by coating apparatus.

The apparatus 10 as described above may be used with a wide variety of ultraviolet and electron beam curable materials. A preferred clear ultraviolet curable material is available from Strathmore Products Inc. of Syracuse, N.Y. under the trade name designation C90-0010U.

While aspects of the invention have been specifically described and illustrated it will be recognized that various modification substitutions and additions may be made to the invention by those of ordinary skill in the art without departing from the spirit and scope of the invention as set forth in the appended claims.

What is claimed is:

1. A method for coating a surface with an ultraviolet (UV) or electron bean curable coating comprising:

providing a coater apparatus cloning a housing having a top wall, side walls attached to the top wall and an open bottom defining a first compartment and a second compartment, a partition wall attached to the top wall between the first compartment and the second compartment for separating the first compartment from the second compartment and for minimizing reflection of curing energy from the coated surface, a coater selected from spray and roll coaters disposed in the first compartment, a curing energy source selected from ultraviolet and electron beam energy sources disposed in the second compartment, wheels rollers rotably attained to the side walls on a lower potion of the housing for moving the housing across the surface during a coating operation and for maintaining a gap between the housing walls and the surface to be coated, and a control unit attached to the housing or remote from the housing for controlling the coater and energy source during a coating and curing operation;

applying the UV or electron beam curable coating to the surface by means of the coater apparatus;

and curing the coating using the ultraviolet or electron beam energy source while moving the coater apparatus across the surface and while minimizing the reflection of curing energy from the coated surface to the first compartment.

2. The method of claim 1 wherein the coater apparatus is moved across the surface to be coated at a speed ranging from about 0 to about 30 feet per minute or more.

3. The method of claim 1 further comprising applying the UV or electron beam curable coating to the surface with a thickness ranging from about 0.5 mils to about 0.25 inches.

4. The method of claim 1 wherein the coater comprises the spray coater and the controller controls spray from the spray coater in response to the speed the coater apparatus is being moved across the surface.

5. The method of claim 1 wherein the controller controls the curing energy source in response to the speed the coater apparatus is being moved across the surface.

6. The method of claim 1 wherein the curing energy source comprises the ultraviolet energy source.

* * * * *